United States Patent [19]

Brandenberg

[11] 4,248,267

[45] Feb. 3, 1981

[54] MULTIPLE ELEMENT FLUID LOGIC CONTROLS

[75] Inventor: Karl A. Brandenberg, Chehalis, Wash.

[73] Assignee: The Aro Corporation, Bryan, Ohio

[21] Appl. No.: 63,923

[22] Filed: Aug. 6, 1979

Related U.S. Application Data

[63] Continuation-in-part of Ser. No. 967,293, Dec. 7, 1978, and a continuation-in-part of Ser. No. 967,292, Dec. 7, 1978.

[51] Int. Cl.³ ..... F15C 3/04

[52] U.S. Cl. ..... 137/885; 235/201 ME

[58] Field of Search ..... 137/885; 235/201 ME

[56] References Cited

U.S. PATENT DOCUMENTS

| | | | |
|---|---|---|---|
| 3,385,322 | 5/1968 | Brandenberg | 137/625.66 |
| 3,389,720 | 6/1968 | Brandenberg | 137/625.66 |
| 4,103,711 | 8/1978 | Arvin | 137/625.66 |

*Primary Examiner*—Gerald A. Michalsky

*Attorney, Agent, or Firm*—Allegretti, Newitt, Witcoff & McAndrews

[57] ABSTRACT

Fluid logic elements are combined in various ways to provide staging, shift register and binary flip-flop functions. The elements used to provide the complex functions include a flip-flop element, sequential AND and sequential NOT elements in various combinations. For example, two sequential AND elements or two sequential NOT elements may be arranged with a single flip-flop element to provide a shift register or a binary flip-flop function. A single sequential AND element or a single sequential NOT element in combination with a single flip-flop element provide a staging function. Combinations of the multiple element devices provide enhanced control functions.

8 Claims, 25 Drawing Figures

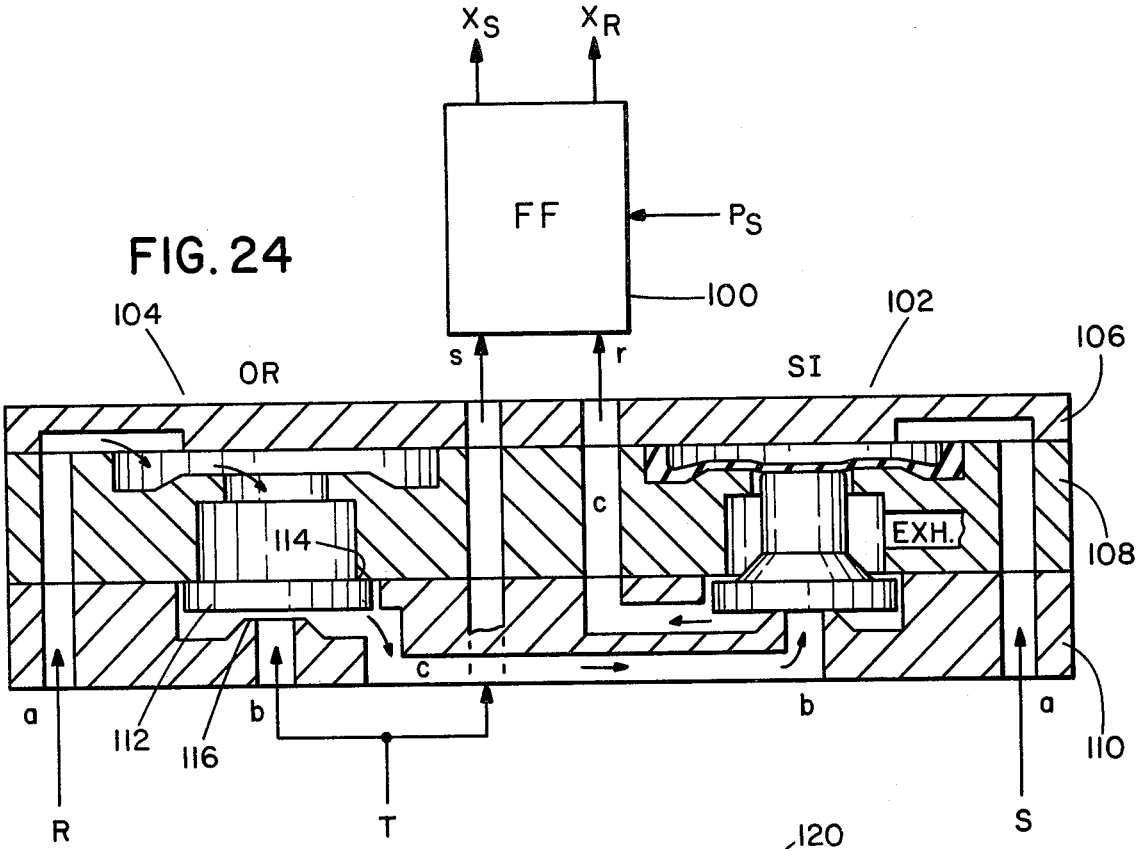
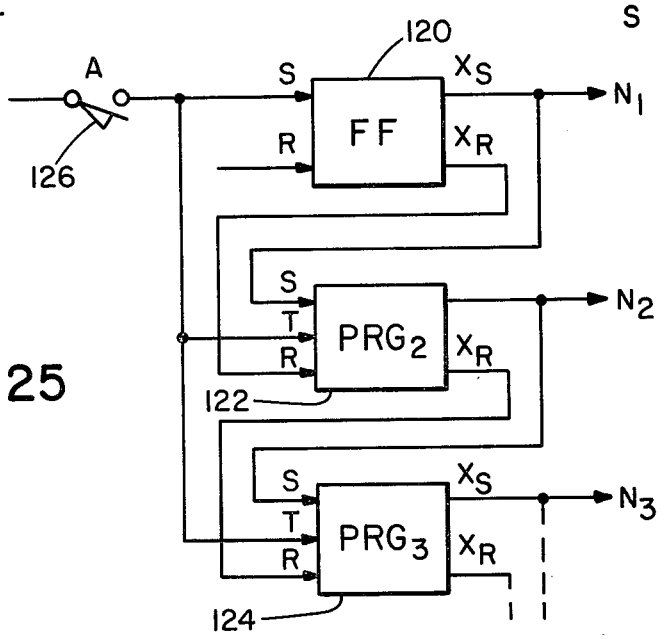
FIG. 25
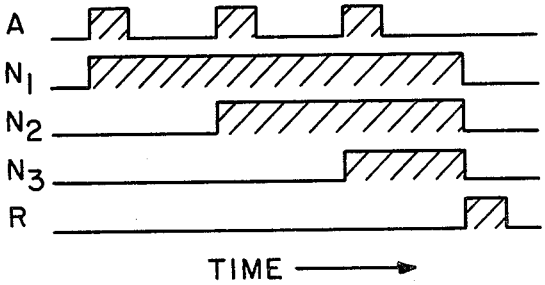
FIG. 26

MULTIPLE ELEMENT FLUID LOGIC CONTROLS

CROSS REFERENCE TO RELATED APPLICATIONS

This is a continuation-in-part application of the following two applications:

1. Brandenberg, Ser. No. 967,293, filed Dec. 7, 1978 for a "Sequential AND Fluid Logic Device".
2. Brandenberg, Ser. No. 967,292, filed Dec. 7, 1978 for a "Sequential Inhibitor (NOT) Fluid Logic Device".

Both applications are incorporated by reference.

BACKGROUND OF THE INVENTION

This invention relates to an improved combination of basic fluid logic elements which provide complex, but well known logic functions. Specifically, a combination of two or three logic elements, i.e. a flip-flop element plus one or two sequential AND elements or sequential NOT elements, provide the binary flip-flop, shift register or staging functions. These combinations are useful in pneumatically controlled environments such as with assembly lines and other manufacturing processes.

Shift Register Control

Conveyor and sorting operations in manufacturing processes require escort memory functions. For example, certain attributes of an object, such as size, shape, and weight may be sensed at one point in a production line and then acted upon when the object has moved further down the line. To accomplish this escort function, the signal generated at the sensing station must be memorized and then escort the object to the station where action is to take place. There the signal is used to initiate a task such as automatic sorting, rejecting or positioning.

It is known that the control requirements of the escort memory function can be implemented with a shift register control. Such a control provides that a signal generated at a sensing station will be passed to a first stage operation by a shift signal pulse. A second shift signal will then pass the sensing station signal to a second stage and so on. The number of shift register stages is equal to the number of objects between the sensing station and the station where a corresponding action is to take place.

Flip-flop elements can be used as basic building blocks for a shift register control since multiple memory functions are required. Heretofore, a considerable amount of additional control elements and other hardware were necessary to build a fluid or pneumatic shift register control using flip-flop elements. This made implementation of a fluid logic shift register control system complex, expensive and generally impractical. Elimination of excess hardware associated with such a fluid shift register control system is therefore considered desirable.

Binary Flip-Flop Control

Another complex control system is known as the binary flip-flop control. Such a control is functionally known and its uses are also known. However, all known systems of binary flip-flop control using fluid or pneumatic elements are complex and require many logic elements. As a consequence, production of a pneumatic binary flip-flop control has heretofore been uneconomical.

Staging Controls

Sequential pneumatic logic control systems constructed with the flip-flop elements have been built and sold for several years. Typically these systems employ staging circuits where each of the flip-flop elements is controlled by a separate input.

Some pneumatic control applications, however, require that the control sequence of a staging circuit advance step-by-step with pressure pulses generated from a single signal source. To provide this type of pneumatic control, it has been necessary to build special cam driven programmers containing a series of mechanically actuated pneumatic valves. Mechanical programmers of the described type have limitations in versatality and may not be adaptable to differing requirements, such as variance of the number of steps per cycle. Heretofore no satisfactory mechanism or system is known to provide complex pneumatic staging circuits which would operate from a single signal source.

SUMMARY OF THE INVENTION

The described control functions, though known to be desirable for pneumatic control applications, have not been economically available nor sufficiently versatile for numerous applications. The present invention comprises an arrangement of pneumatic or fluid logic elements which provide the desired functions and overcome those problems previously described.

Briefly, the present invention comprises a complex fluid or pneumatic control device made from a flip-flop element in combination with one or more sequential AND or sequential NOT elements. Combinations of the described elements provide a shift register, binary flip-flop or staging control. Physically the complex control devices can be manufactured in integrated pneumatic logic units not appreciably larger than a flip-flop element.

Thus, it is the object of the present invention to provide an improved complex pneumatic control device which incorporates simplified fluid logic elements in combination to provide a shift register, binary flip-flop or staging control.

A further object of the present invention is to provide a complex pneumatic control device incorporating a flip-flop element in combination with one or more sequential AND or sequential NOT elements. The AND or NOT elements are incorporated with the base of the flip-flop element thereby rendering a compact, reliable and economical complex control device.

Still a further object of the present invention is to provide a pneumatic control device which incorporates a flip-flop element and two sequential AND elements to provide a shift register function or a binary flip-flop function.

One further object of the present invention is to provide a pneumatic control device comprising a flip-flop element and two sequential NOT elements to provide a shift register or a binary flip-flop function.

Another object of the present invention is to provide a pneumatic control device which combines a flip-flop element and a sequential NOT or a sequential AND element to provide a staging control function.

These and other objects, advantages and features of the invention will be set forth in the detailed description which follows.

BRIEF DESCRIPTION OF THE DRAWING

In the detailed description which follows reference will be made to the drawing comprised of the following figures:

FIG. 24 is a cross sectional view of a device having the function and elements shown in FIG. 23;

FIG. 25 is a circuit diagram for a multiple stage programmer; and

FIG. 26 is a graphical representation of the operation of the multiple stage programmer of the type illustrated in FIG. 25.

DESCRIPTION OF THE PREFERRED EMBODIMENT

Figure 1:
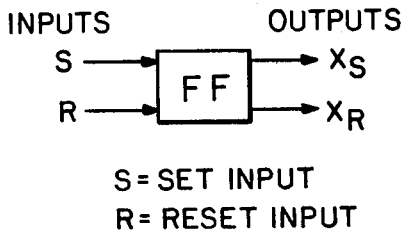
FIG. 1 is a diagramatic logic symbol for a typical flip-flop pneumatic logic element.
Figure 2:
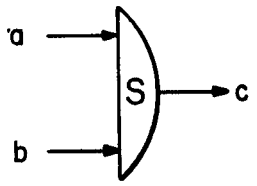
FIG. 2 is a diagramatic logic symbol for a typical sequential AND pneumatic logic element.
Figure 3:
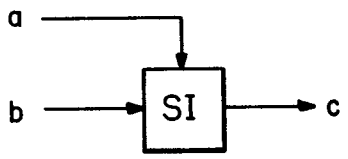
FIG. 3 is a diagramatic logic symbol for a sequential NOT pneumatic logic element.
Figure 4:
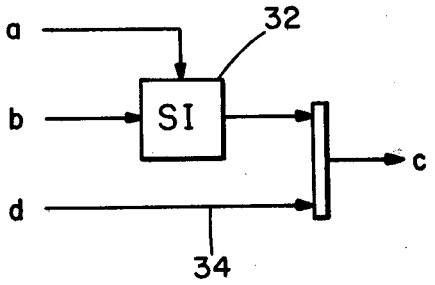
FIG. 4 is a diagramatic logic symbol for the combination of a sequential NOT and an OR pneumatic logic element.

The figures are divided into four separate groups. FIGS. 1–4 represent the building blocks or basic pneumatic fluid logic elements which are utilized to build the more complex logic devices which are the subject matter of the claims. FIG. 1 is a symbol for a flip-flop element. FIG. 2 is a symbol for a sequential AND element. FIG. 3 is a symbol for a sequential NOT element.

FIGS. 5–10 relate to a shift register device. FIGS. 11–19 relate to a binary flip-flop mechanism and FIGS. 20–26 relate to a staging programming device.

Building Block Elements

The standard pneumatic flip-flop element is one of the basic building blocks utilized to make the more complex devices described below. Referring to FIG. 1, a standard flip-flop element is schematically illustrated by a standard symbol or diagrammatic representation. The flip-flop element includes two inputs, a set input (S) and a reset input (R). The element also includes two outputs, one of those outputs ($X_X$) being associated with the set input (S) and the other output ($X_R$) being associated with the reset input (R). One of the outputs ($X_R$) or ($X_S$) is always "on" and the other output ($X_S$) or ($X_R$) is always "off". Applying a signal to one of the inputs, (S) or (R), turns the corresponding output ($X_S$) or ($X_R$) respectively, "on" and turns the other output "off". If the corresponding output was already "on" the flip-flop element will remain in the same state.

The input signals (S) or (R) are variously referred to as signals (s) or (r) when internal and (S) or (R) when external or primary input signals. The input signals (S) or (R) can be of any duration, either momentary or maintained. However, input signals (S) or (R) must not be applied to both inputs at the same time. If they are simultaneously applied to both inputs, no switching will occur. Also, the flip-flop element must have "threshold switching" for use in the complex circuits described below. Switching thus should occur preferably at a control pressure equal to 50% or more of the normal supply pressure to the flip-flop element. A flip-flop element having the above described characteristics is disclosed in the patent to Arvin, U.S. Pat. No. 4,103,711, issued Aug. 1, 1978, which is incorporated herewith by reference.

In the development of the complex logic functions to be described below, a second element, which is identified as a sequential AND element, is utilized. FIG. 2 schematically illustrates a sequential AND element. The element includes a first input (a) and a second input (b) with a single output (c). An output signal results whenever the input signals are provided sequentially to the first input (a) and the second input (b). Both signals (a) and (b) must be provided in the proper sequential order and then simultaneously persist in order to have an output (c). An element having the described function is disclosed in detail in the co-pending application of Brandenberg entitled "Sequential AND Fluid Logic Device", Attorney Case No. 78,370, Ser. No. 967,293, filed Dec. 7, 1978. That co-pending application is incorporated herewith by reference.

FIG. 3 illustrates a third basic fluid logic element which is used to provide the complex functions described in greater detail below. That third element is termed a sequential inhibitor or sequential NOT element. As shown in the schematic illustration, FIG. 3, the sequential NOT element has a control input (a), a supply input (b) and an output (c). The output signal from (c) is terminated only if a control signal at control input (a) precedes a supply signal at supply input (b). The device is described in detail in co-pending Brandenberg application entitled "Sequential Inhibitor (NOT) Fluid Logic Device", Attorney Case No. 78,376, Ser. No. 967,292, filed Dec. 7, 1978. This co-pending application is incorporated herein by reference.

An additional variation of the sequential NOT is also described in the co-pending application, Ser. No. 967,292. The variation of the sequential NOT element 32, incorporates usage of an exhaust passage (d) or 34 associated with the NOT element 32. When the exhaust passage (d) is utilized as an input, the sequential NOT 32 provides the function illustrated in FIG. 4. That is, an output signal (c) results only in the event of (1) an input through the exhaust (d) or (2) only when a signal from supply input (b) precedes a control signal at control input (a). This variation of the sequential NOT is described in the referenced Brandenberg application which has been incorporated herewith by reference.

This background of basic building block logic elements enables one to construct and understand the complex devices of the present invention.

Shift Register Device

Figure 5:
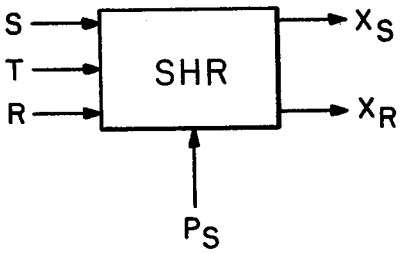
FIG. 5 is a diagramatic logic symbol for a shift register pneumatic logic device.

FIG. 5 is the logic symbol for the shift register device which incorporates various elements described above. The integrated shift register device illustrated in FIG. 5 includes the following pneumatic signals: a set input (S), a trigger input (T), a reset input (R), a set output ($X_s$), a reset output ($X_R$) and a supply ($P_s$). The device will switch into the set position and provide a set output ($X_s$) only if set input (S) and trigger input (T) are present, the reset input (R) is absent and trigger input (T) arrives after the set input (S). If the trigger input (T) arrives first, before the set input (S), switching will not occur because the trigger input (T) is blocked. Trigger input (T) must switch "off" and then receive a subsequent shift pulse and switch "on" again to effect switching of the element into the set position having a set output ($X_s$). Similarly, to provide a reset output ($X_R$), reset input (R) and trigger input (T) must be present and set input (S) must be absent with the reset input (R) preceding the trigger input (T).

Figure 6:
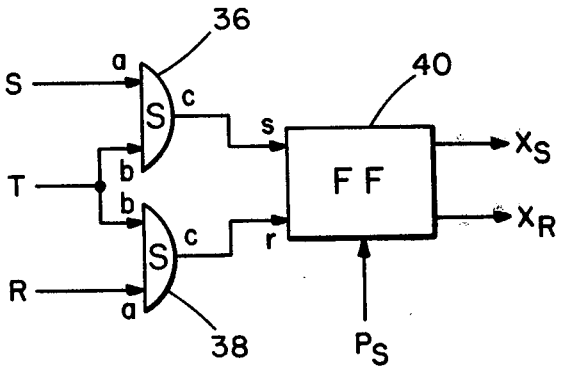
FIG. 6 is a circuit diagram illustrating the internal logic element circuit of a shift register device incorporating a flip-flop element and two sequential AND elements.

FIG. 6 illustrates schematically the combination of elements and their internal circuitry to provide a shift register device. Two sequential AND elements 36 and 38 are combined with a single flip-flop element 40 to provide the shift register device. FIG. 6 includes the same symbology as set forth above with respect to FIGS. 1, 2 and 5. Thus, outputs (c) of sequential AND 36 and 38 are connected respectively to flip-flop set and reset inputs (s) and (r). Trigger input (T) is defined as a parallel signal connection with the inputs (b) of both sequential ANDs 36 and 38.

Figure 7:
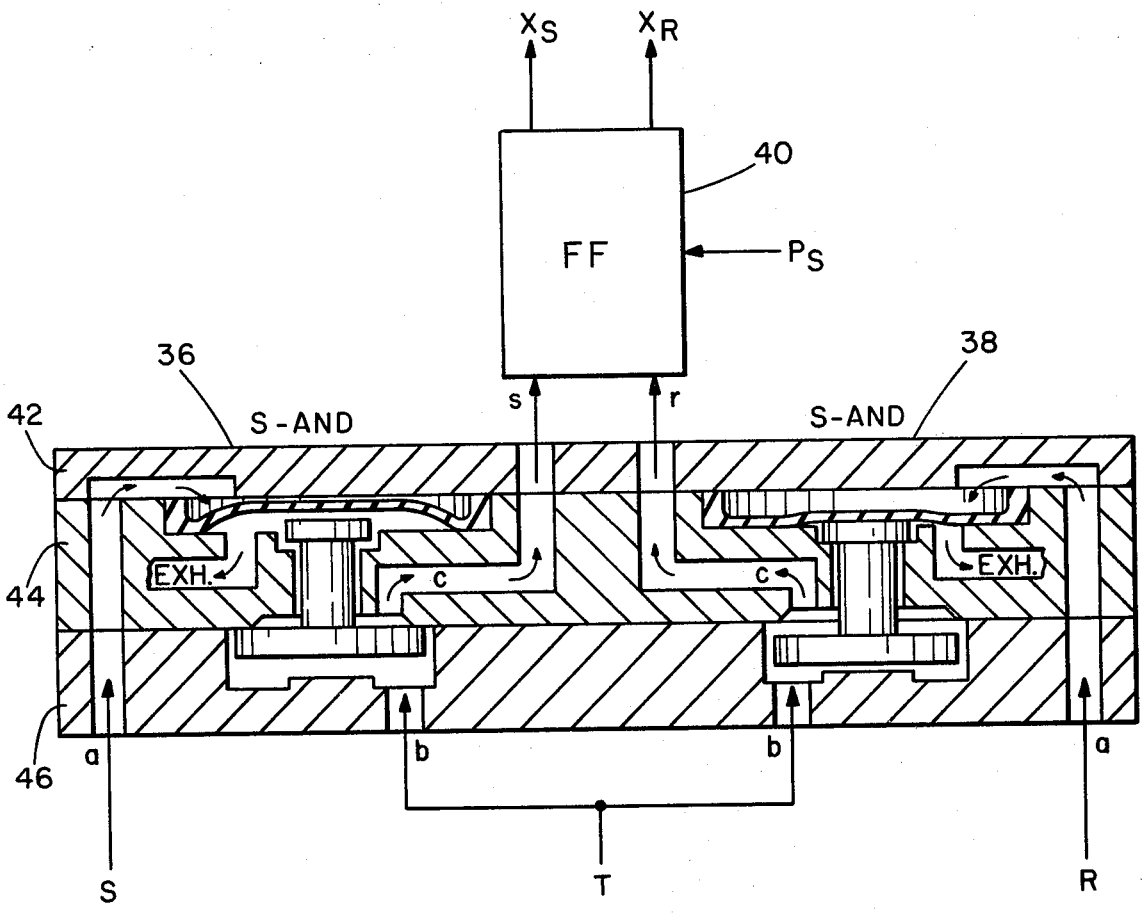
FIG. 7 is a cross sectional view of the fluid logic device of FIG. 5 incorporating a flip-flop and sequential AND logic elements to provide the shift register function.

FIG. 7 is a cross sectional view of a typical integrated fluid logic device schematically illustrated in FIG. 6. The device is comprised of flip-flop element 40 corresponding identically to that set forth in the Arvin U.S. Pat. No. 4,103,711 mounted upon a laminated series of plates 42, 44, and 46 which define first and second sequential AND devices 36 and 38. The sequential AND devices 36, 38 are identical to those described in detail in pending Brandenberg application Ser. No. 967,292 (Attorney Case No. 78,376 ). The entire assembly may be mounted on a circuit board of the type illustrated in Brandenberg U.S. Pat. No. 3,407,833. In this manner a compact integrated shift register device or assembly is provided.

Figure 8:
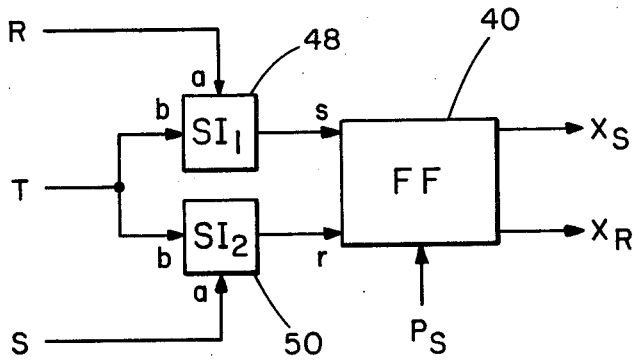
FIG. 8 is a pneumatic logic circuit diagram illustrating the internal logic element circuit of a shift register device incorporating a flip-flop element and two sequential NOT elements.

FIG. 8 schematically illustrates the combination of two sequential inhibitor or NOT elements 48, 50 in combination with a flip-flop element 40 to provide a shift register device which is equivalent to the device described with respect to FIGS. 5–7. The device illustrated in FIG. 8 includes a flip-flop element 40 which is identical to that previously described, in combination with first and second sequential NOT devices 48 and 50. The symbols utilized in FIG. 8 for the reset and set inputs (R) and (S) and trigger input (T) are the same as those of FIG. 5. The signals (a), (b) and (c) associated with the sequential NOT elements 48 and 50 are the same as those set forth with respect to FIG. 3.

Figure 9:
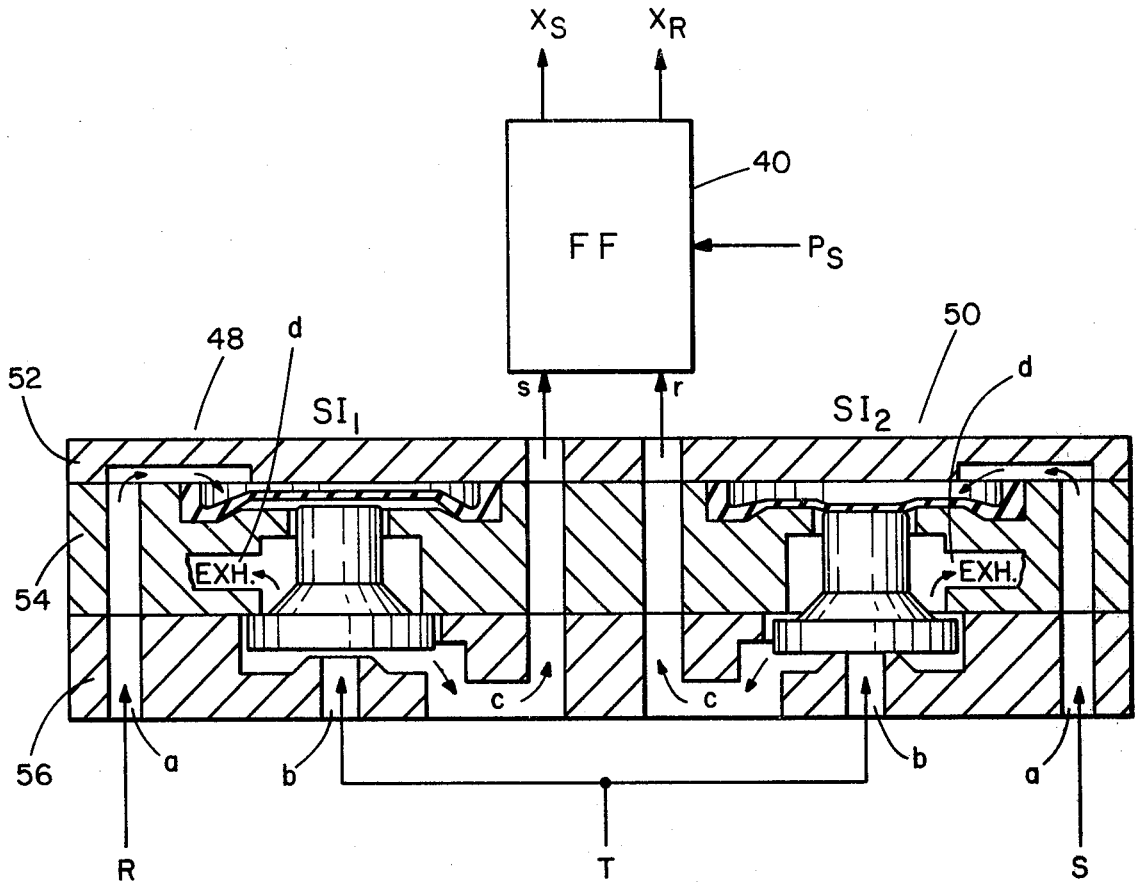
FIG. 9 is a cross sectional view of the device made in accordance with the circuit diagram of FIG. 8.

FIG. 9 is a cross sectional view of an integrated device which incorporates flip-flop 40 with sequential NOT's 48 and 50. The sequential NOT's 48 and 50 are fabricated and defined in plates 52, 54 and 56 which are laminated to provide a structure set forth in the previously referenced Brandenberg application Ser. No. 967,292, Attorney Case No. 78,376. Note that the various passages of the NOT devices 48 and 50 have been labeled to conform the labeling of signals (a), (b), (c) and (d) in FIGS. 8 and 9.

The composite device illustrated in FIGS. 8 and 9 operates in the following manner. The device will switch to provide a set output signal ($X_S$) only if set input (S) and trigger input (T) are present and reset input (R) is absent provided trigger input (T) arrives after set (S). Under these conditions the trigger input (T) passes through the sequential NOT 48 to the input (S) of flip-flop 40 causing flip-flop 40 to provide output ($X_S$). Trigger input (T) will not pass through to the input (r) because the second sequential NOT 50 is in the inhibit position due to the presence of the set signal (S). If the trigger input signal (T) arrives first before set signal (S), no switching will occur when the set input signal (S) is turned "on". This results since neither of the sequential NOT elements 48, 50 can provide an output when the trigger signal (T) is made simultaneously at both the input (S) and reset (R) of the flip-flop 30. Trigger input signal (T) must first be switched "off"; whereupon, the second sequential NOT 50 may assume the inhibit position and then back "on" again to switch the device into the set position.

Similarly when switching to the reset output signal position ($X_R$), reset input (R) and trigger input (T) must be present and set signal input (S) absent. Trigger input signal (T) must arrive after reset signal (R).

The device of FIG. 9 may also be arranged on a circuit board in the same manner described with respect to the arrangement of FIG. 7.

Figure 10:
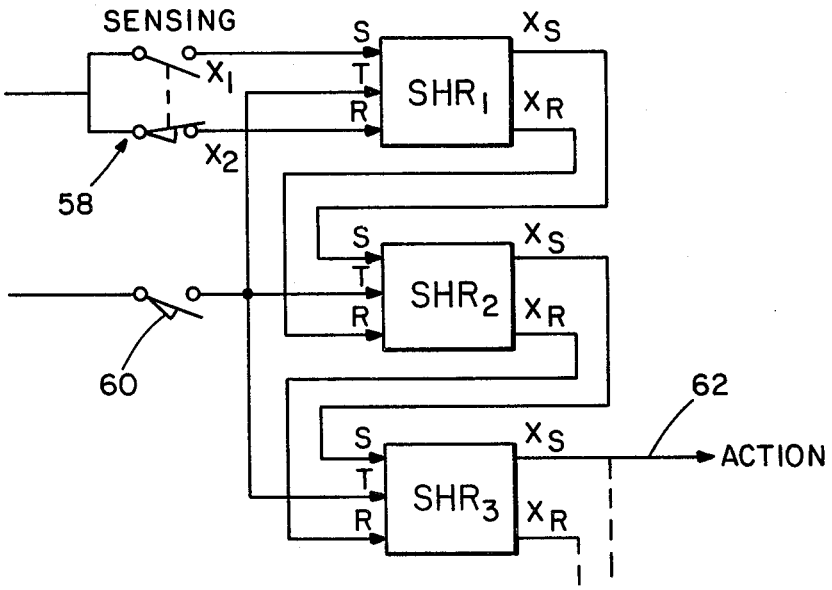
FIG. 10 is a circuit diagram illustrating use of a plurality of shift register devices of the type shown in FIG. 5.

FIG. 10 illustrates the arrangement of a series of devices of the type schematically represented by FIG. 5 to provide a total shift register circuit. The shift register devices as schematically shown in FIG. 5 are connected in series. Thus, a sensing device 58 is designed to operate two opposing outputs, i.e. a four way valve. Single shift or trigger pulses are generated by a separate pneumatic device or shifting device 60. Typically, the shifting device 60 would be a limit valve switch actuated by movement of a conveyor mechanism, for example. The shift pulses generated by the shifting device 60 are applied simultaneously to all of the trigger inputs (T) of the shift register devices ($SHR_1 \ldots SHR_x$) in the series. The sensing device 58 may be shifted to the ($X_1$) position to provide signal to shift register device ($SHR_1$). The input (X2) is "off" at this time and for this reason the reset input (R) is "off". No switching occurs upon merely sensing the action by operation of sensing device 58. If a shift signal is applied due to operation of shifting device 60, a trigger signal (T) will cause the first shift register device ($SHR_1$) to switch to the set position whereby an output signal ($X_s$) is provided to the input (S) of the second shift register device ($SHR_2$). There will be no output signal from the second device ($SHR_2$) because the internal mechanism of the element requires about ten milliseconds to respond to a control signal. Since the trigger signal (T) precedes the input signal (S) to the second element ($SHR_2$) no switching will occur.

Upon a subsequent operation of the shifting device 60 first to the "off" position and then back to the "on" position, a shift pulse will flow from output ($X_s$) of second element ($SHR_2$) to the input (S) of the third element ($SHR_3$). Thus a second shift pulse is required to switch the second element ($SHR_2$), a third pulse is required to switch the third element ($SHR_3$) and so on. Output action is effected by arranging an output signal 62 in parallel with an appropriate output signal ($X_s$) of one of the shift register devices. In device ($SHR_3$), for example, three operations of shifter 60 are necessary to effect action at station 3 in response to sensing at the main statlion 58.

In a similar fashion, the same relations apply to the reset input (R) and the associated reset output ($X_R$). Shift pulses are implemented by operation of the shifting device 60 which provides a trigger signal (T). This occurs provided, of course, that the sensing device 58 provides a sensing pulse signal ($X_2$) at the first device ($SHR_1$) of the shift register and more particularly at the reset input (R) of device ($SHR_1$).

Binary Flip-Flop Device

Figure 11:
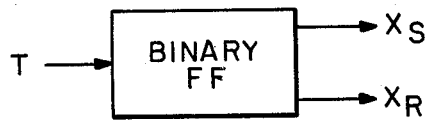
FIG. 11 is a diagramatic logic symbol for a pneumatic device providing a binary flip-flop function.

FIG. 11 is the schematic logic symbol for the binary flop-flop device which incorporates various building block elements described above. The integrated binary flip-flop device illustrated in FIG. 11 includes a trigger input (T). Every pneumatic pulse signal applied to this trigger input (T) reverses the state of the outputs ($X_S$) and ($X_R$) regardless of the original state of the device.

Figure 12:
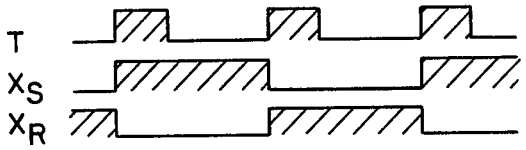
FIG. 12 is a graph representing the operation of the device of FIG. 11.
Figure 13:
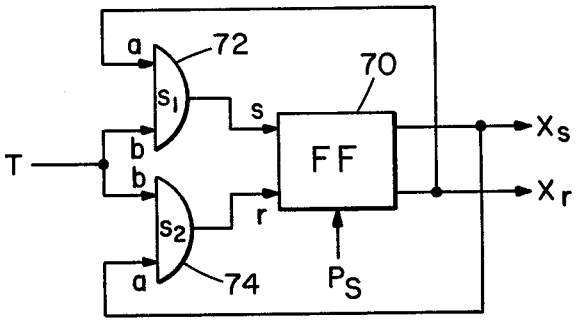
FIG. 13 is a circuit diagram illustrating the internal logic element circuit for a binary flip-flop device as shown in FIG. 11 incorporating two sequential AND elements and a flip-flop element.

The device is schematically illustrated in FIG. 13 and operational characteristics of the device are shown graphically in FIG. 12. Thus, as shown in FIG. 12, the trigger input signal (T) is pulsed in order to effect switching output from the output ($X_R$) to the output ($X_S$) and vice versa.

FIG. 13 illustrates schematically the combination of building block elements and their connecting circuitry to provide a binary flip-flop device. Note that the arrangement of FIG. 13 is substantially identical to that of FIG. 6 except that the inputs (a) for the sequential AND devices 72 and 74 are provided respectively by the outputs ($X_R$) and ($X_S$) of the flip-flop 70.

Assuming that the flip-flop 70 is in the reset position wherein output ($X_S$) is "off" and output ($X_R$) is "on", the inlet port (b) of sequential AND 74 is blocked and input port (b) of sequential AND 72 is open. Thus, a trigger signal (T) can travel through the sequential AND 72 to the input port (s) of flip-flop 70; though, the trigger signal (T) cannot travel through the sequential AND 74 to the input (r) of flip-flop 70. Consequently, the flip-flop 70 reverses its state causing output ($X_S$) to switch "on" and output ($X_R$) to switch "off". Sequential AND element 74 now receives a signal at input (a). This, however, causes no switching since the signal at input (b) of sequential AND 74 arrived prior to input signal (a) at sequential AND 74. Sequential AND 72 therefore switches "off" because the signal at its input (a) disappears.

If the trigger signal (T) now switches "off", the sequential AND 74 will go into an actuated position. However, no signal at input (r) is generated without a signal at input (b) of AND 74. Another trigger signal (T) will now be able to go through the sequential AND 74 but not through sequential AND 72. This will cause the flip-flop 70 to switch over to its original position thereby reversing the operation just described.

Figure 14:
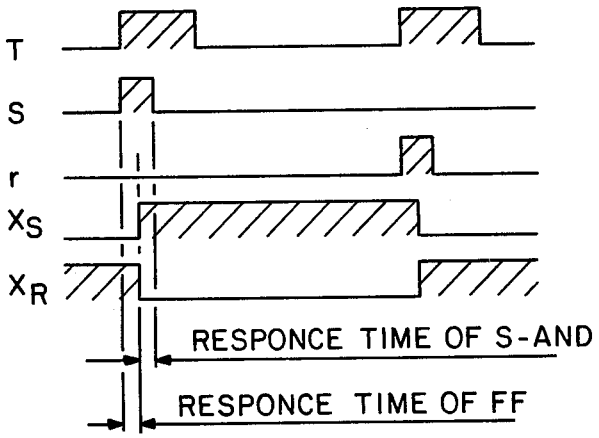
FIG. 14 is a graph illustrating the functional operation of the device of FIG. 13.

This described operation is graphically illustrated in greater detail in FIG. 14 wherein the operation of the trigger signal (T), output signals ($X_R$) and ($X_S$) and internal flip-flop input signals (s) and (r) have been illustrated on a time scale. Note that the duration of signals (r) and (s) to the flip-flop 70 are equal to a summation of the response times of the sequential AND 72 (or 74) and the flip-flop 70.

Figure 15:
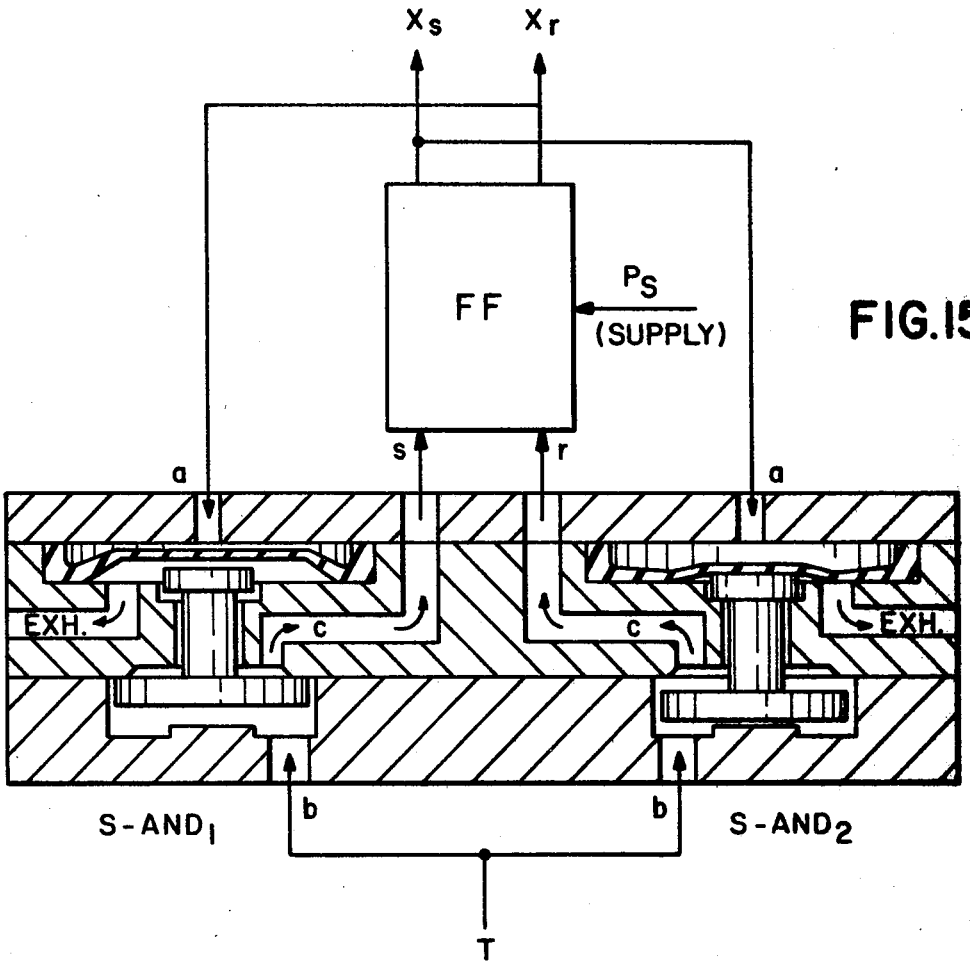
FIG. 15 is a cross sectional view of the device shown in FIG. 13.

FIG. 15 is analogous to FIG. 13 and illustrates in cross section the combination of two sequential ANDs in combination with the schematic illustration of flip-flop 70. The structure and operation of the sequential ANDs is as described previously.

Figure 16:
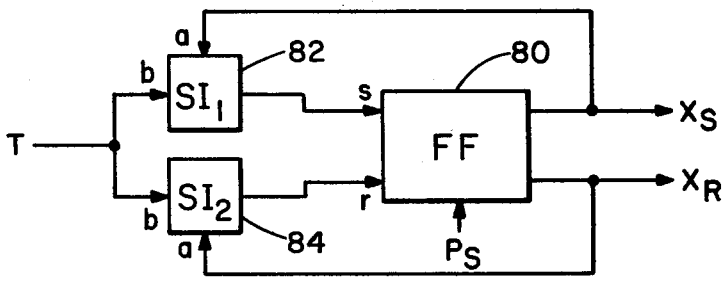
FIG. 16 is a circuit diagram for a binary flip-flop device incorporating two sequential NOT elements and a flip-flop element.

FIG. 16 illustrates an alternative arrangement of building block elements to provide the binary flip-flop function just described. In the alternative embodiment illustrated by FIG. 16, sequential inhibitors or NOTs 82 and 84 are used in combination with a flip-flop 80. Parallel connections from outputs ($X_S$) and ($X_R$) of the flip-flop 80 connect respectively with the input (a) of sequential NOTS 82, 84 respectively. The other inputs (b) of NOTS 82, 84 are connected with the same triggering signal source.

The device schematically illustrated in FIG. 16 operates in a manner which is substantially identical to the operation of the device illustrated in FIG. 13. Also, the device of FIG. 16 is schematically illustrated by FIG. 11 and its function is schematically illustrated by FIG. 12. Thus, trigger input signals (T) will cause the outputs ($X_R$) and ($X_S$) to switch in response to successive trigger inputs.

By utilizing the exhaust port associated with the sequential NOT devices 82 and 84 as an input, it is possible to convert the device illustrated in FIG. 16 into a device known as the RST flip-flop. With such a device the set-reset function is incorporated with the operation of the flip flop.

Figure 17:
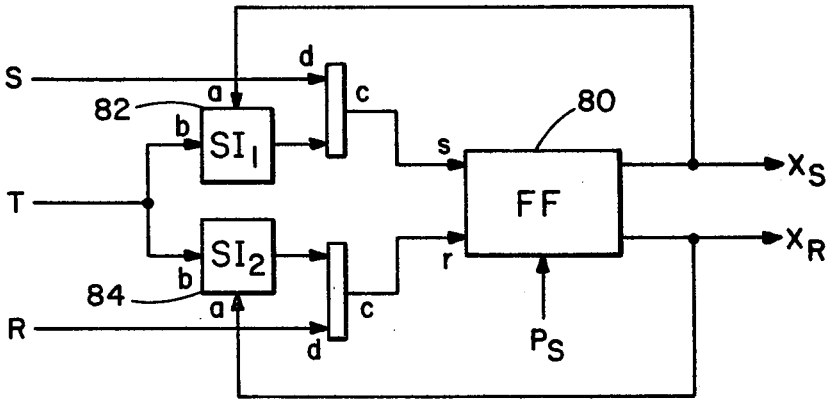
FIG. 17 is a circuit diagram for a binary flip-flop control device incorporating two sequential NOT elements, two OR elements and a flip-flop element.
Figure 18:
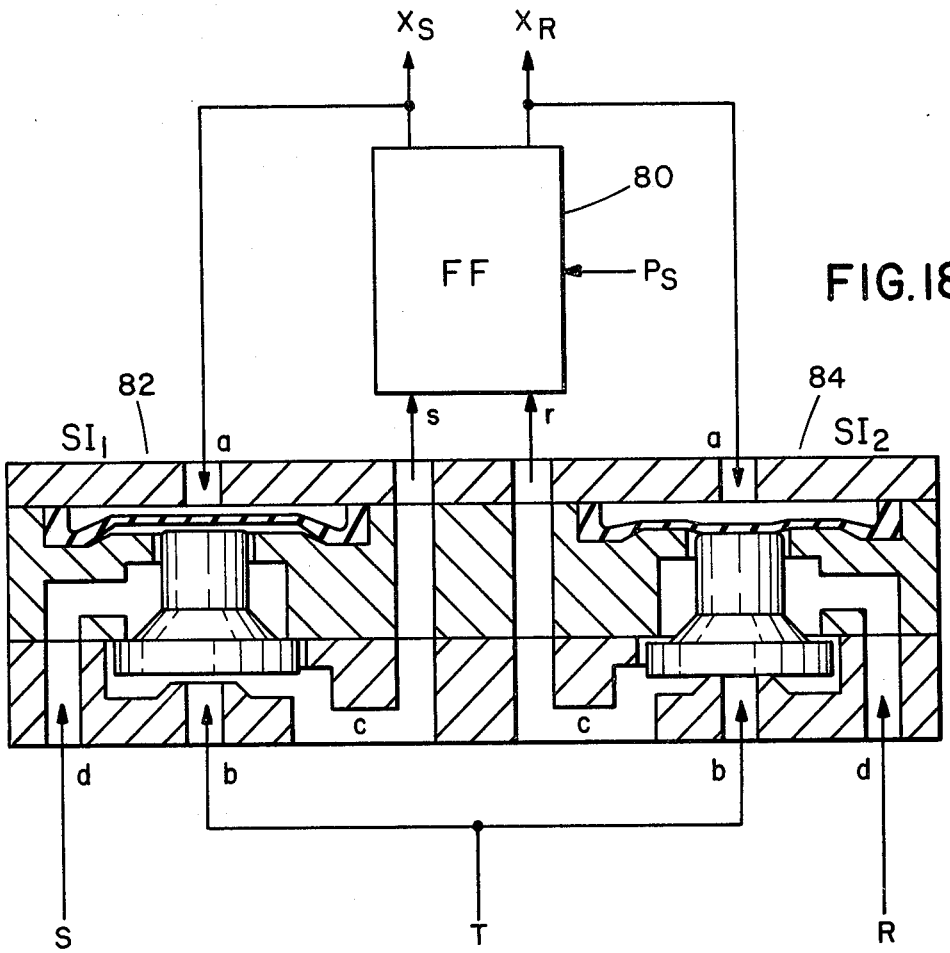
FIG. 18 is a cross sectional view of the device of FIG. 16 and FIG. 17.
Figure 19:
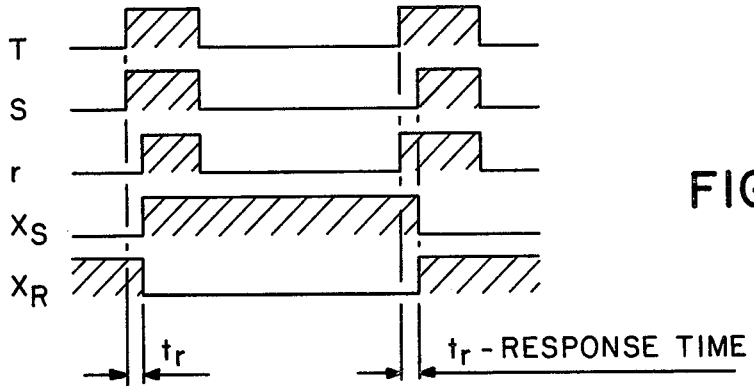
FIG. 19 is a graphical representation of the function of the binary flip-flop device shown in FIGS. 15–18.

FIG. 17 illustrates schematically the circuit diagram to provide an RST flip-flop device. FIG. 18 illustrates in cross section the arrangement of the sequential NOT devices 82 and 84 in combination with a flip-flop 80 to provide an RST flip-flop. FIG. 19 is a pulse-time diagram illustrating the operation of an RST flip-flop.

The RST flip-flop operates in the following manner: Assuming that flip-flop 80 is in the reset position, then output ($X_S$) is "off" and output ($X_R$) is "on". The two outputs, ($X_R$) and ($X_S$) of the flip-flop 80 are connected to the control inputs (a) of the sequential NOTS 82 and 84 respectively. Since output ($X_S$) is "off", sequential NOT 82 does not act to inhibit its input port (b). Conversely, since output ($X_R$) is "on", sequential NOT 84 does inhibit input port (b). A trigger signal (T) which is connected to the inputs (b) of sequential NOTS 82 and 84 can thus travel through sequential NOT 82 to the input (s) of flip-flop 80. It is, however, inhibited from going to the input (r) of flip-flop 80 because of the action of sequential NOT 84.

In this manner, the flip-flop 80 reverses output ($X_S$) to the "on" position and output ($X_R$) to the "off" position. Upon such reversal a signal arrives at the input (a) of sequential NOT 82 via output ($X_S$). This signal is unable to block the trigger signal (T) at input (b) of NOT 82 because the signal at (b) arrived first. However, since output ($X_R$) has switched "off", sequential NOT 84 will be released so that the trigger signal can travel through to the input (r) of the flip-flop 80. This, however, has no consequence because the other flip-flip input signal (s) is already present thereby neutralizing the first signal (r). Consequently the flip-flop remains in the set position. When the trigger signal (T) is switched "off", the sequential NOT 82 will remain in the inhibit position because of the presence of pressure at input (a). Another trigger signal (T) will be able to go through sequential NOT 84 but not through sequential NOT 82 thereby causing the previous operation to repeat in reverse. Thus, switching of the flip-flop device is effected by an input (S), an input (R), or an appropriate trigger input (T).

Staging Programming Device

Figure 20:
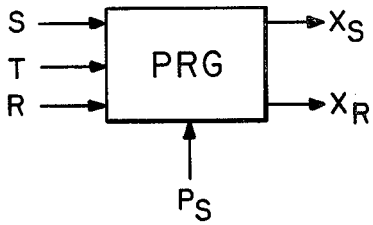
FIG. 20 is a pneumatic logic symbol for a pneumatic staging programming device.

FIG. 20 is the logic symbol for a single stage of a programming device. The programming device includes the various elements described above as building blocks. The programming device shown in FIG. 20 includes a set input (S), a trigger input (T), a reset input (R), a set output ($X_S$), a reset output ($X_R$), and a supply ($P_s$). The device will switch into the set position only if signals (S) and (T) are present, signal (R) is absent, and the trigger signal (T) arrives after signal (S).

If the signal (T) arrives first, no switching will occur and the signal (S) turns "on". The signal (T) must first switch "off" and back "on" again to switch the element into the set position. A signal to input (R) resets the element.

Figure 21:
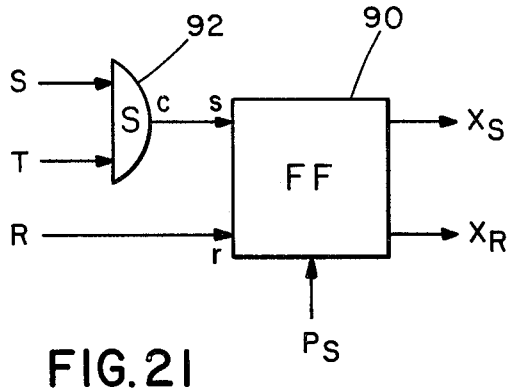
FIG. 21 is a circuit diagram illustrating symbolically the internal circuitry of a staging programming control which incorporates a single sequential.

FIG. 21 illustrates schematically the arrangement of logic elements comprising the programming device of FIG. 20. As shown in FIG. 21, a flip-flop 90 is used in combination with one sequential AND device 92. The set input (S) and trigger input (T) comprise inputs to the sequential AND 92. The output (c) of the AND 92 provides an input (s) to flip-flop 90. Reset input (R) connects with reset input (r) of flip-flop 90.

Referring to the logic function for the programming device described above, the device switches into the set position only if signals (S) and (T) are present and signal (R) is absent provided signal (T) arrives after set input (S) since under these conditions the trigger signal (T) can go through the sequential AND 92 to the flip-flop input (s). Note that a signal at the reset input (R) will provide a reset output ($X_R$) if there is no signal from the sequential AND 92 to the flip-flop input (S).

Figure 22:
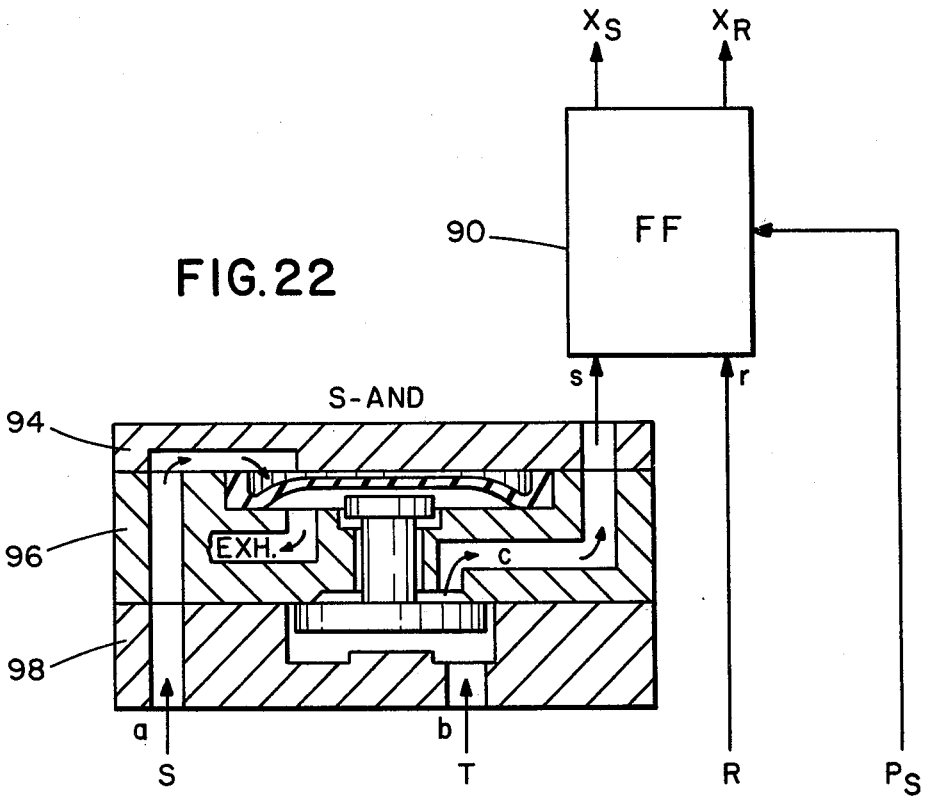
FIG. 22 is a cross sectional view of a device having the functions and elements shown in FIG. 21.

FIG. 22 is a cross sectional view of a sequential AND device in combination with a schematic representation of a flip-flop illustrating the arrangement of the various ports and channels of the sequential AND 92 and flip-flop 90 to provide the programmer device of FIG. 21. The sequential AND 92 may be formed from plate elements 94, 96 and 98 with the flip-flop 90 mounted on the plate 94 to provide an integrated programming device analogous to the integrated shift register and binary flip-flop devices previously described.

Figure 23:
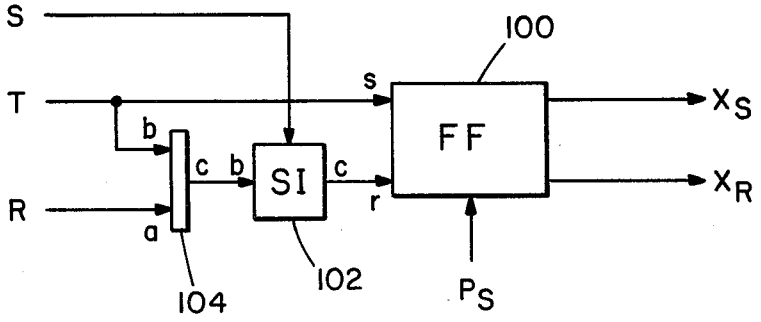
FIG. 23 is a circuit diagram of a staging programming device incorporating a flip-flop element and a sequential NOT element.

FIGS. 23 and 24 illustrate an alternative embodiment of a programming device using a flip-flop element 100 in combination with a sequential NOT 102 and an OR element 104. FIG. 23 schematically illustrates the circuit diagram for connecting the elements 100, 102 and 104. FIG. 24 illustrates in cross section, the arrangement of plates 106, 108, and 110 to form a sequential NOT 102 and an OR device having a flip-flop element 100 mounted on the plates 106, 108 and 110 to provide an integrated device.

The OR device includes a floating poppet 112 adapted to seat against inlet seal 114 associated with inlet (a) or inlet seat 116 associated with inlet (b). Fluid flow through either inlet (a) or (b) will transpose poppet 112 to one of the seats 116 or 114 respectively thereby permitting fluid flow from exit channel (c) of the OR which is connected to inlet channel (b) of the sequential NOT 102.

The device of FIGS. 23 and 24 has the same function as described with respect to FIG. 20. That is, the device will switch into the set position only if signals at input (S) and trigger input (T) are present and reset input signal (R) is absent provided trigger input signal (T) arrives after set input signal (S). Under these conditions the trigger signal arrives at the input (S) of flip-flop 100 but no signal arrives at input (R) of flip-flop 100 because the sequential NOT 102 is in the inhibit position due to the presence of the set input signal (S).

If the trigger signal (T) arrives first, no switching will occur when the set input signal (S) turns "on". This results because the sequential NOT 102 cannot assume the inhibit position and the trigger signal (T) is present at the set input (s) of flip-flop 100 as well as the reset input (r) of the flip-flop 100. To cause switching, the trigger signal (T) must switch "off" whereupon the sequential NOT 102 assumes the inhibit position, and then back "on" again to switch the device into the set position. A signal to the reset input (R) resets the device provided set input signal (S) and trigger input signal (T) are absent.

FIGS. 25 and 26 illustrate how a series of programming devices of the type illustrated in FIGS. 20–24 can be arranged in a staging-programming circuit. The first stage of such a circuit contains a flip-flop element 120. Subsequent stages of the circuit include programming devices 122, 124. The circuit is arranged as shown in FIG. 25 wherein an input control signal source 126 provides parallel input signals to the set input (S) of flip-flop 120 and the trigger signal inputs (T) of the programmer devices 122, 124. Outputs ($X_S$) for performing or initiating certain operations are designated as operation output signals (N1, N2, N3, etc.). An input reset signal (R) is connected to the initial flip-flop element 120 and the output ($X_R$) of the flip-flop 120 is arranged in series with subsequent program devices 122 and 124 as reset input signal (R).

A first pulse from the input control 126 will switch the flip-flop element 120 and its associated control output (N1) to the "on" position. None of the subsequent stages will switch, however, because the control input signal (a) pressurizes all of the trigger signal inputs (T) of the programming elements 122, 124, etc. Though input (S) of the first stage programming device 122 receives a signal in parallel with the control output ($N_1$), that signal arrives subsequent to the trigger input (T) because the internal mechanism associated with the flip-flop 120 requires about 10 milliseconds to respond to the control signal. Accordingly, the trigger signal (T)

arrives prior to the set input signal (S) at programming device 122. The trigger signal (T) and consequently the control input 126 must therefore switch "off" and "on" once again in order to activate the second stage program device 122.

A third pulse of the control input 126 is needed to excite the third stage program device 124. Likewise stage (X) will be excited by pulse (X) generated by control input 126. A pulse signal to reset input (R) will reset the entire chain of program devices 122, 124 etc. and flip-flop 120. FIG. 26 illustrates this operation schematically on a signal time graph.

The interconnections between flip-flop elements 120 and subsequent stages 122, 124 of program devices may be effected by using passageways or channels defined in mounting plates for integral elements of the type shown in FIGS. 22 and 24. In this manner a compact, complex staging-programming circuit may be provided for control of a pneumatic device for example.

Thus, while there has been set forth a preferred embodiment of the invention, it is to be understood that the invention is limited only by the following claims and their equivalents.

What is claimed is:

1. A fluid operated logic device comprising in combination:

(a) at least one fluid logic flip-flop element having a set input (s), a reset (r), a fluid supply ($P_s$), a set output ($X_S$), and a reset output ($X_R$), wherein applying a fluid signal to one of the inputs (s) or (r) causes the corresponding output ($X_S$) or ($X_R$) to provide or maintain a fluid signal; and (b) at least one associated sequential fluid logic AND element, said sequential element having a first input (S), a second supply input (T) and an output (c), said output (c) being connected to the input (s) of the flip-flop element.

2. The system of claim 1 wherein said system comprises a fluid logic shift register system incorporating two sequential AND elements arranged in parallel to provide inputs to the flip-flop, one of said AND elements defining a first input (S), an output (c) connected with the said flip-flop input (s), the second sequential AND defining a supply input (R) and an output (c) connected to the said flip-flop input (r), the second input (b) of the second sequential AND being connected in parallel with the second input (b) of the first sequential AND, both of said inputs (b, b) being connected with a second trigger supply input (T) whereby said composite shift register device will switch into a set position only if input signal (S) and trigger signal (T) are present, input signal (R) is absent and trigger signal (T) arrives after input signal (S).

3. The system of claim 2 in combination with a plurality of said systems in series.

4. The improved logic system of claim 1 comprising a single sequential AND device having a first input (S), a second trigger input (T), an output (c) connected to the said flip-flop input (s) and a separate input (R) connected directly with the flip-flop input (r) whereby the composite element will switch into the set position only if the input signal (S) and trigger signal (T) are present, input signal (R) is absent and trigger signal (T) arrives after input signal (S).

5. The system of claim 4 in combination with a plurality of said systems in series.

6. A fluid operated logic device comprising in combination:

(a) at least one fluid logic flip-flop element having a set input (s), a reset input (r), a fluid supply ($P_s$), a set output ($X_S$), and a reset output ($X_R$), wherein applying a fluid signal to one of the inputs (s) or (r) causes the corresponding output ($X_S$) or ($X_R$) to provide or maintain a fluid signal; and (b) fluid logic means for introducing a signal to the flip-flop inputs including at least one sequential fluid logic element whereby the output signals of the flip-flop element ($X_R$, $X_S$) provide a shift register control function.

7. A fluid logic device comprising in combination:

(a) at least one fluid logic flip-flop element having a set input (s), a reset input (r), a fluid supply ($P_s$), a set output ($X_S$), and a reset output ($X_R$), wherein applying a fluid signal to one of the inputs (s) or (r) causes the corresponding output ($X_S$) or ($X_R$) to provide or maintain a fluid signal; and (b) two identical sequential fluid logic elements arranged in parallel circuit connection for introducing signals to the inputs (r, s) of the flip-flop element whereby the output signals of the flip-flop element provide a shift register control.

8. A fluid operated logic device comprising in combination:

(a) at least one fluid logic flip-flop element having a set input (s), a reset (r), a fluid supply ($P_s$), a set output ($X_s$), and a reset output ($X_R$), wherein applying a fluid signal to one of the inputs (s) or (r) causes the corresponding output ($X_s$) or ($X_R$) to provide or maintain a fluid signal; and (b) at least one associated sequential fluid logic NOT element, said sequential element having a first input (S), a second supply input (T) and an output (c), said output (c) being connected to the input (s) of the flip-flop element.

* * * * *